US005437001A

United States Patent [19]

Chaney et al.

[11] Patent Number: 5,437,001

[45] Date of Patent: Jul. 25, 1995

[54] UPRIGHT RADIANT ELECTRIC HEATING APPLIANCE

[75] Inventors: David B. Chaney, Powell; Barry W. Smith, Dublin; Thomas H. Mills, Urbana, all of Ohio

[73] Assignee: The W. B. Marvin Manufacturing Company, Urbana, Ohio

[21] Appl. No.: 994,416

[22] Filed: Dec. 21, 1992

[51] Int. Cl.[6] ..... H05B 3/32; F24H 3/02

[52] U.S. Cl. ..... 392/376; 392/373; 392/375; 392/383; 392/422

[58] Field of Search ..... 392/376, 373, 375, 383, 392/416, 420, 422

[56] References Cited

U.S. PATENT DOCUMENTS

| | | | |
|---|---|---|---|
| D. 111,000 | 8/1938 | Knox et al. . | |
| D. 141,834 | 7/1945 | Maxson, Jr. . | |
| D. 267,424 | 12/1982 | Boldt et al. . | |
| D. 281,811 | 12/1985 | Horst, Sr. . | |
| D. 290,391 | 6/1987 | Nakamura . | |
| D. 325,251 | 4/1992 | Schindler et al. . | |
| D. 329,692 | 9/1992 | Chaney et al. . | |
| 2,131,484 | 7/1935 | Ringwald . | |
| 2,329,592 | 9/1943 | Clemons . | |
| 2,707,745 | 5/1955 | Farr et al. . | |
| 2,852,657 | 9/1958 | Markel et al. . | |
| 3,051,820 | 8/1962 | Krichton | 392/376 |
| 3,059,090 | 12/1960 | Waters . | |
| 3,175,550 | 2/1963 | Knapp . | |
| 3,610,882 | 10/1971 | Omohundra . | |
| 3,806,314 | 4/1974 | Obuchi et al. | 219/388 |
| 3,811,208 | 5/1974 | Vieceli et al. | 38/77.8 |
| 4,309,593 | 1/1982 | Jones et al. | 219/377 |

OTHER PUBLICATIONS

Advertisement published by Patton Electric Company, Inc., New Haven, Ind., *Patton Wide Angle*, published at least as early as Sep. '91, on sale several months prior to Sep. '91.

Catalog page titled *Quartz Heater and Electric Heaters*, published by W. B. Marvin Manufacturing Co., Urban, Ohio Jul. '92.

Copy of brochure *Portable Electric Heaters*, published by W. B. Marvin Manufacturing Co., Urban, Ohio, Feb. '88.

*Primary Examiner*—Mark H. Paschall

*Attorney, Agent, or Firm*—Roger S. Dybvig

[57] ABSTRACT

An upright radiant electrical heater has a reflector assembly supporting a vertically-extending heating element assembly that radiates energy through substantially 360 degree. The reflector assembly includes heat reflective panels that disperse heat horizontally over substantially 90 degrees through an open grill at the front of the heater and vertically in a substantially uniform manner so that hot spots are avoided. A fan forces room air into the heater from below the reflector assembly, upwardly through an air passage behind the assembly into an open control chamber at the top of the heater, and outwardly into the room through ducts along the top front edge of the assembly. A thermostatic control for the heating element assembly and the fan motor is located in the air passage at the top of the heater. The flowing air maintains the exterior of the heater relatively cool to the touch, allowing parts of the housing to be molded from a thermoplastic material into aesthetically-pleasing shapes. Power is supplied to the heating element assembly by one or more cold wires including a horizontally-extending cold wire section located between the bottom of the heating element assembly and the top of the fan blade. The heating element assembly includes coiled resistance wires which are mounted in tension in order to reduce noise created by the heating element assembly when first energized.

33 Claims, 4 Drawing Sheets

FIG-2
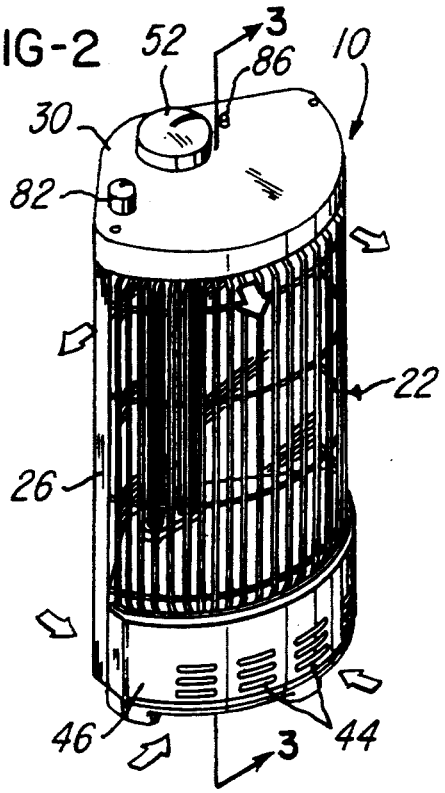
FIG-3
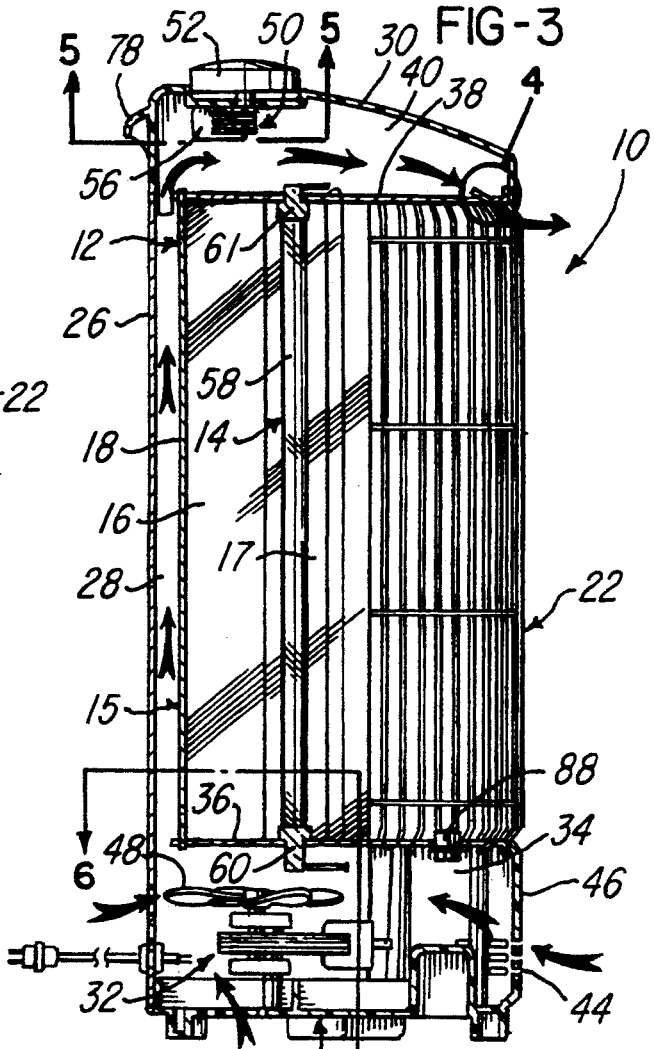
FIG-5
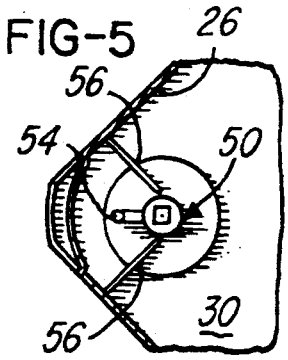
FIG-4
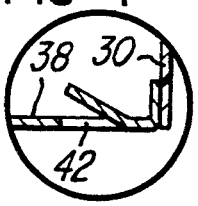
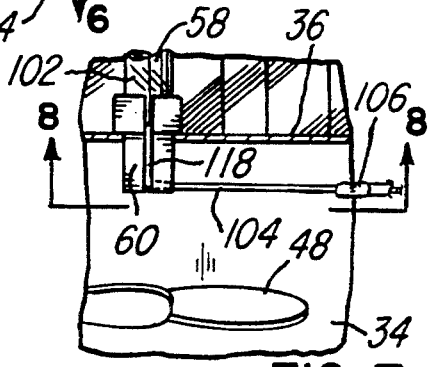
FIG-7
FIG-6
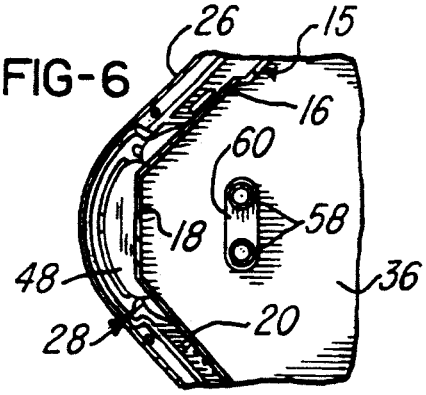
FIG-8
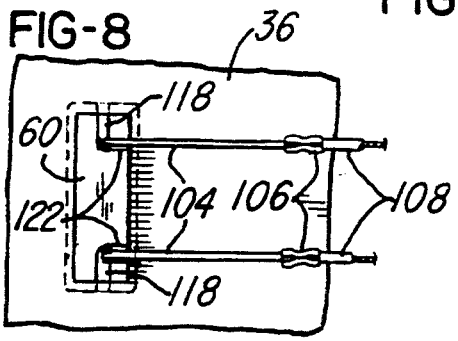

14
61
118
122
116
120
106
108
112
104
100
102
58
60
110
114
113

50
THERMOSTAT
80
POWER SWITCH
14
HEATER
84
PILOT LIGHT
90
BUZZER
FAN
32
THERMAL LIMITER
88
POWER SOURCE

UPRIGHT RADIANT ELECTRIC HEATING APPLIANCE

BACKGROUND OF THE INVENTION

This invention relates generally to portable electric room air heaters and particularly to upright radiant heaters suitable for placement in a corner or any other location in a room while occupying a minimum amount of floor space. As will become apparent to those familiar with the art, aspects of this invention may be used with other types of heaters.

An upright or so-called "tower" heater is relatively tall in relation to its horizontal area or "footprint." Examples are shown in U.S. Design Pat. No. 111,000, granted Aug. 23, 1938, to C. Knox et al., and U.S. Design Pat. No. 141,834 granted to W. E. Maxson, Jr. on Jul. 10, 1945. These may be contrasted to horizontal heaters that have a relatively low profile, such as shown in U.S. Pat. No. 3,175,550, issued to R. S. Knapp on Mar. 30, 1965, U.S. Pat. No. 3,059,090, granted to R. S. Waters on Oct. 16, 1962, and U.S. Pat. No. 3,610,882, issued to William A. Omohundra on Oct. 5, 1971.

One of the problems encountered in any portable heater is the creation of localized "hot spots" on or adjacent the heater. These are areas that get much hotter than adjacent areas. Hot spots are undesirable because they can present a fire hazard as well as cause discomfort to the user of a heater. Portable electric air heaters sold in the United States at this time must meet testing requirements of Underwriter's Laboratories, Inc. when in actual service, so that the heaters do not present a risk of fire, electric shock or personal injury when operated continuously under abnormal conditions. With many heaters, such tests can only be passed successfully by the use of relatively expensive safety control devices.

SUMMARY OF THE INVENTION

An object of this invention is to provide a portable heater which is inherently designed to avoid the formation of hot spots and therefore, avoid the need for all but basic electrical safety devices.

Another object of the invention is to provide an efficient, upright radiant electric heating appliance which occupies minimal floor space, is easy to operate, and which is capable of heating a room relatively rapidly.

Another object is to provide a thermostatically-controlled room air heater with accurate on-and-off cycling to maintain or increase to desired room temperatures. Ancillary thereto is an object of minimizing, simplifying and reducing cost of the structure for controlling such a thermostat.

Another object of the invention is the provision of such a heater which has exterior housing portions which are relatively cool to the touch, thereby allowing such portions to be produced from thermoplastic molded materials that may readily be manufactured to various different shapes. This enables designers of heaters to design heaters of various aesthetically pleasing designs that may be produced at lower costs than similar heaters which have all metal housings.

An upright radiant electric heating appliance in accordance with this invention has a reflector assembly that includes radiant heat reflective side panels which lie in vertical planes that intersect one another at an included angle of between 90 and 180 degrees, a vertically-extending heating element assembly located near the rear of the reflector assembly that radiates heat energy throughout substantially 360 degrees in a horizontal direction, and a circular open grill at the front of the reflector assembly. Heat energy is directly radiated by the heating element assembly through the open grill or reflected by the reflective side panels through the open grill.

In a preferred embodiment, the heating element assembly is preferably spaced on the order of eight inches or more from the open grill and each reflective side panel is similarly spaced from the opposite side of the open grill. Accordingly, most of the heat energy reaching the open grill has traveled at least eight inches from the heating element assembly or from a reflective side panel. Because the reflective side panels lie at a mutually included angle of 90 degrees or more the reflected heat energy is dispersed across the open grill into the surrounding area. Hot spots are avoided because none of the heat energy is focused. The reflective side panels may be formed with vertical ribs for rigidity and also to create a pleasing visual effect due to the reflection from different planes of the visible light created by the heating element assembly.

Also forming part of the reflector assembly are horizontally extending, reflective top and bottom walls. Heat energy impinging on these walls and exiting from the open grill at the front of the reflector assembly is also dispersed across the open grill into the surrounding area. The horizontal top and bottom walls also avoid any focusing of the heat energy which might produce hot spots.

The reflector assembly may also include a reflective rear panel that connects the side panels and that is located behind the heating element assembly. Heat energy reflected by the rear panel is mostly reflected back to the heating element assembly or to the side panels. The reflective side panels and rear panel preferably are formed from a single piece of sheet metal, preferably tin plated steel. The reflective top and bottom walls can be separately formed from the same material.

Further in accordance with this invention, room air is drawn into the heater from below the reflector assembly and forced upwardly by a motorized fan through an air passage behind the reflector assembly and then through an open control chamber at the top of the heater before passing through ducts positioned along the top front edge of the reflector assembly. As well known, the air temperature at the floor of a room is cooler than the air above the floor and becomes increasingly warmer toward the ceiling of the room. Accordingly, air drawn into the bottom of the heater of this invention is relatively cool. This air is warmed as it rises inside the heater housing because it picks up heat from the backside of the reflective side and rear panels. A thermostatic control is positioned in the inside top portion of the heater. This location, as opposed to the bottom of the heater, is deemed better representative of the room air temperature sought to be obtained because of the warming of the relatively cool air drawn into the bottom of the heater. A thermostat located at the top of the heater tends to cycle on and off more frequently than would be the case if the thermostat were located upstream of the reflector assembly, near the bottom of the heater, but it enhances the ability of the thermostat to so control the heater as to maintain a relatively constant room temperature. In the preferred practice of this invention, baffles are provided to direct the air flow toward the thermostat. In addition, the power switch is also located at the top of the heater and control knobs for both the power switch and the thermostat extend upwardly from the top of the housing for ease of operation.

As a result of the combined effect of the cooling of the heater caused by the air flowing upwardly from the bottom of the heater and the sensitivity and responsiveness of the thermostatic control, a heater in accordance with this invention may have exterior housing parts which are relatively cool to the touch, thereby allowing selected exterior housing parts to be molded from thermoplastic materials which can readily be formed to aesthetically pleasing designs.

Yet another object of this invention is to provide an improved quartz heating element assembly for use in an electric heater and, more particularly, an improved heating element assembly which may be located above a fan blade. Such a heating element assembly in accordance with this invention comprises a pair of quartz heating elements each of which comprises a resistance heater wire inside a heat-radiating quartz tube. The tubes are closed at their ends by ceramic holders. Two cold wires or rods, one at each end of the resistance wire, are spot-welded to the resistance wire in each tube. The ends of the cold rods opposite the ends thereof welded to the resistance wire are connected, as by crimped connectors, to flexible wires that connect the heating elements into the heater control circuit. The cold wire at the bottom of each heating element extends horizontally outwardly in the space between the fan blade and the lower ceramic holder to a point sufficiently spaced in a horizontal direction from the center axis of the fan blade that the flexible wire can be safely connected thereto at that point.

Yet another object of this invention is to decrease the noise associated with the operation of quartz heaters. A quartz heating element typically produces an annoying noise each time it is energized. In accordance with this invention, the noise is substantially reduced by placing the resistance heater wire under slight tension by elongating it so that its coils are not simply stacked, in a relaxed condition, one on top of the other. The elongation is relatively quite small, on the order of $\frac{5}{8}$ inch for a resistance heating wire having a coiled length of about $14\frac{1}{4}$ inches, and does not appear to separate the coils from one another. An elongation which is adequate to substantially decrease the start-up noise can be determined by trial and error, but is preferably only so much as to reduce noise. A substantial elongation, such as would cause the wire coils to be noticeably spaced from one another, would likely adversely affect the useful life of the heating element. The reasons why such a relatively small elongation decreases the start-up noise is not fully known, but may be due to the lessening of the frictional engagement between the mutually adjacent coils which are caused to vibrate relative to one another due to magnetic effects which are present during start-up. The magnetic effects would presumably disappear as soon as the resistance wire heats to a temperature exceeding its Curie temperature.

To achieve their desired elongation, the coiled resistance wires are suspended from the upper ceramic holder by means of cooperating surfaces of the upper ceramic holder and the upper cold wires and, in addition, the resistance wires are stretched by the desired amount in order to bring surfaces of the lower cold wires into engagement with downwardly facing surfaces of the lower ceramic holder.

Other objects and advantages will become apparent from the following description and the accompanying drawings.

BRIEF DESCRIPTION OF THE DRAWINGS

FIG. 2 is a perspective view, on a smaller scale than FIG. 1, of the heater of FIG. 1.

FIG. 3 is a vertical, sectional view of the heater of FIG. 2 taken substantially along the lines 3—3 of FIG. 2 and on a larger scale than FIG. 2.

FIG. 4 is an enlargement of circled portion 4 at the upper right hand corner of FIG. 3, with parts omitted.

FIG. 5 is a fragmentary cross-sectional view looking upwardly along lines 5—5 of FIG. 3.

FIG. 6 is a fragmentary cross-sectional view taken generally along lines 6—6 of FIG. 3.

FIG. 7 is an enlarged, fragmentary sectional view of part of the lower, left center portion of FIG. 3.

FIG. 8 is a fragmentary plan view taken substantially along lines 8—8 of FIG. 7.

DETAILED DESCRIPTION

Figure 1:
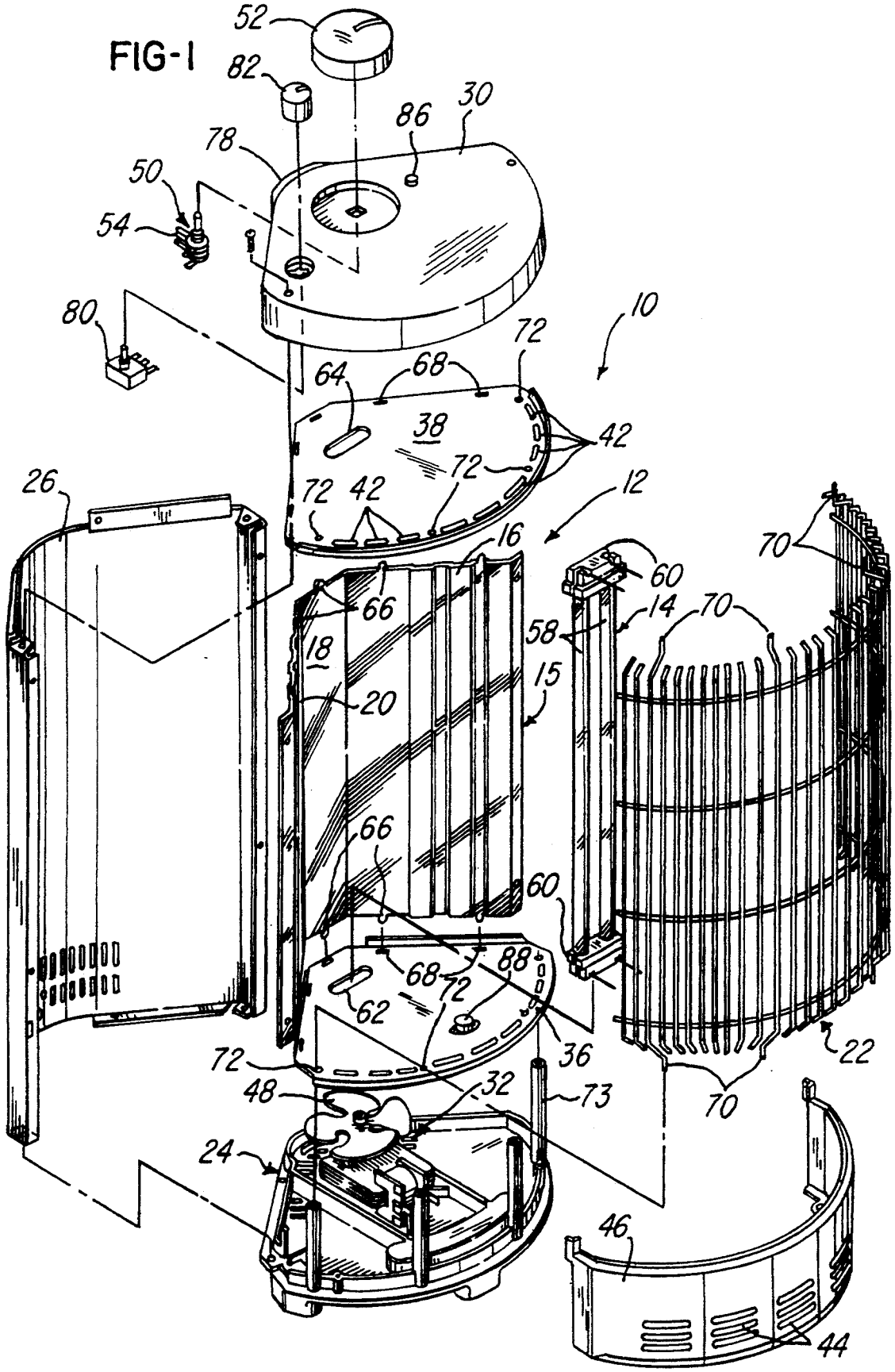
FIG. 1 is an exploded perspective view of the primary elements of the upright radiant electric heating appliance of this invention.
Figures 9, 10, 11, 12:
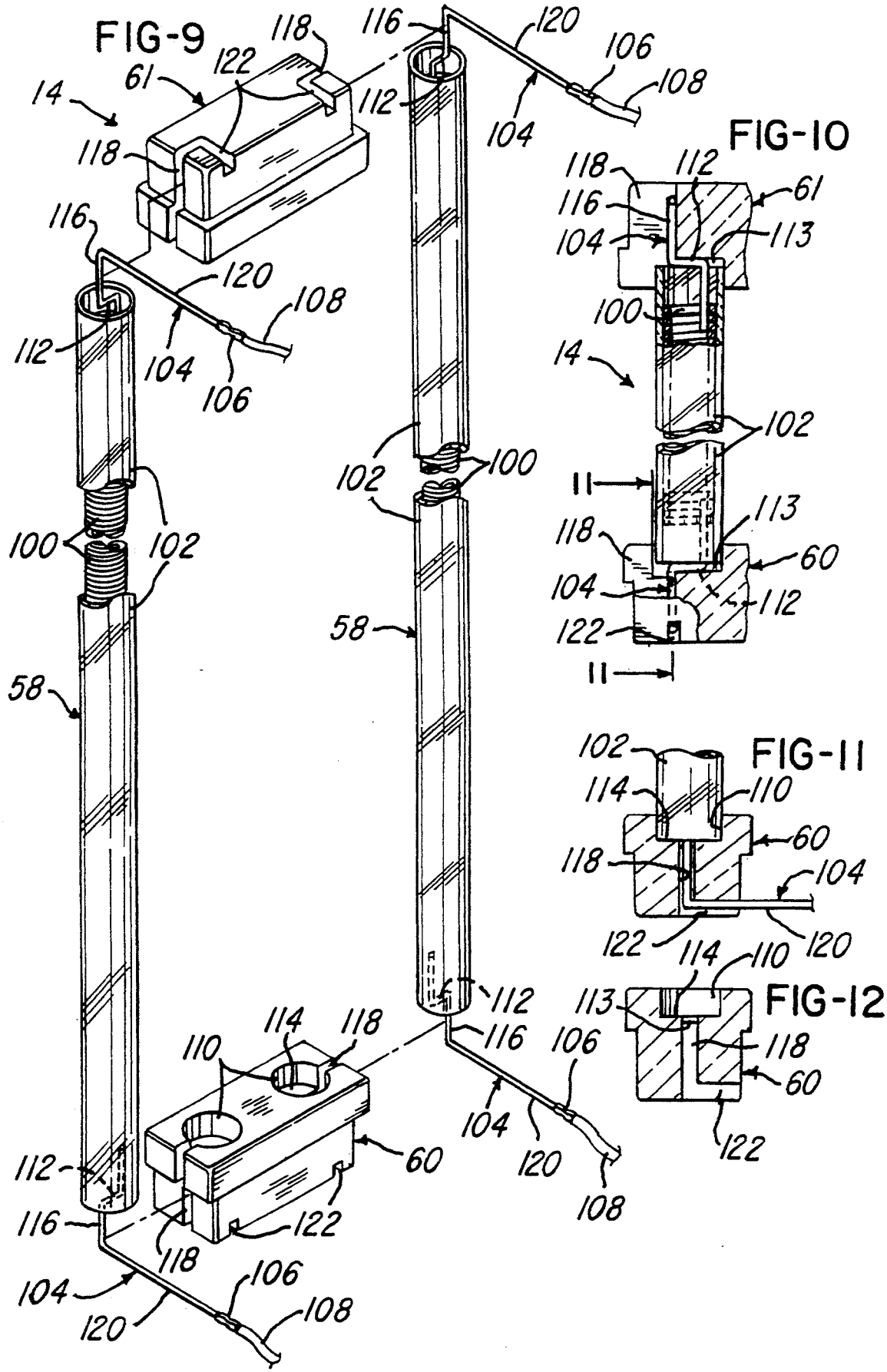
FIG. 9 is a fragmentary, partially exploded, perspective view of a heating element assembly forming part of the heating appliance of this invention.
FIG. 10 is an fragmentary side elevational view, with parts in cross section, of the heating element assembly of FIG. 9.
FIG. 11 is a fragmentary, cross-sectional view, taken along lines 11—11 of FIG. 10, of a portion of the heating element assembly.
FIG. 12 is a cross-sectional view, also taken along line 11—11 of FIG. 10, of a lower ceramic holder used in the heating element assembly.

With reference to FIGS. 1, 2 and 3, an upright, radiant electric heating appliance in accordance with this invention, and embodying the features discussed in the foregoing Summary of the Invention, is generally designated 10 and includes a radiant heating assembly consisting of a reflector assembly, generally designated 12, and a vertically-extending heating element assembly, generally designated 14, supported by the reflector assembly 12.

With reference to FIGS. 1 and 6, reflector assembly 12 includes a one-piece, vertically-extending reflector, generally designated 15, a horizontal, reflective bottom wall 36, and a horizontal, reflective top wall 38. The reflector 15 and the reflective bottom and top walls 36 and 38 define a vertical heating chamber 17 (FIG. 3) which, in horizontal section, is in the shape of a truncated segment of a circle that generally matches the shapes of the walls 36 and 38. Reflector 15 has three vertically-extending, reflective panels 16, 18 and 20. Side panels 16 and 20 lie in respective vertical planes that intersect one another behind the rear panel 18 at an included angle of substantially 90 degrees and the rear panel 18 joins to the side panels 16 and 20 at mutually equal included angles in excess of 90 degrees. The reflector 15 and the reflective bottom and top walls 36 and 38 are preferably made from tin plated steel sheet or other suitably reflective sheet metal.

The heating element assembly 14 is located in the rear portion of the heating chamber 17 and radiates energy throughout substantially 360 degrees toward the reflective front surfaces of the vertical panels 16, 18 and 20 and toward an arcuately-extending, open front grill 22 covering the front of the reflector assembly 12. Heat generated by the heating element assembly 14, therefore, radiates both directly outwardly from the heating element assembly 14 and by reflection from the panels 16, 18, and 20 toward the grill 22. Panels 16 and 20 are preferably vertically ribbed for purposes of rigidity and to create a pleasing visual effect. The heating element assembly 14 is preferably at least on the order of eight inches from the front grill 22.

Surrounding the panels 16, 18 and 20 and mounted on a base plate assembly 24 is a rear housing panel or outer wrapper 26. The outer wrapper 26 is spaced horizontally from the rear surfaces of the panels 16, 18 and 20 to provide an air passage 28 which is generally V-shaped in horizontal cross section as shown in FIG. 6.

The top of the appliance 10 is covered by a top cap 30 which supports control members described below. The appliance 10 preferably stands approximately two feet tall, enabling easy access to the control members.

A motor and fan assembly 32 is mounted in a fan chamber 34 formed between the bottom of the base plate assembly 24 and a bottom wall 36 of the reflector assembly 12. The top cap 30 is spaced above the horizontal top wall 38 of the reflector assembly 12 to provide a control chamber 40 between the top wall 38 and the top cap 30 at the top of the appliance 10. Fan chamber 34, air passage 28 and control chamber 40 are all in communication so that ambient room air taken into fan chamber 34 can flow upwardly through the V-shaped air passage 28, into the control chamber 40 and out through plural ducts 42 spaced along the front edge of the top reflector wall 38 and shown in enlarged fashion in FIG. 4. The ducts 42 are formed by striking plate-like portions 43 upwardly from the sheet metal that forms the top wall 38. The plate-like portions 43 function as air deflectors which extend upwardly and rearwardly in the path of the air flowing through the control chamber 40 to assist in directing the air forwardly of the appliance 10. (For manufacturing convenience, walls 36 and 38 are both provided with ducts, but they perform no real utilitarian function in the bottom wall 36.) As shown by solid arrows in FIG. 3, intake air is received through louvers 44 in a front housing panel 46 as well as through the bottom of the base plate 24 and lower rear portion of the outer wrapper 26 (See FIG. 1). The outer periphery of the blades 48 of the motor and fan assembly 32 is closely adjacent the outer wrapper 26 so that sufficient portions of the fan blades 48 move through an area aligned with the air passage 28 to force air to flow directly upwardly through the air passage 28, maximizing air flow at the rear corner of the appliance 10 for purposes to be described.

The top cap 30 is tapered downwardly from the rear toward the front of the appliance 10 so that the cross-sectional area of the control chamber 40 diminishes from front to rear. Accordingly, the flowing air approaches the ducts 42 with increasing speed and forms a generally horizontal sheet of air that is expelled through the ducts 42 from the front top edge of the reflector assembly 12. Thus, air flowing through the ducts 42 will draw heat away from the internal top portion of the reflector assembly 12 where rising heat tends to accumulate. The resulting effect is that the temperatures of the entire rear surface of the reflector assembly 12 and the adjoining housing parts are reduced by the air flow created by the motor and fan assembly 32.

As the air flows upwardly past the vertical reflector 15, it acquires some of the heat of the reflector and increases in temperature before it impinges upon a thermostatic element 50 shown in FIGS. 1, 3 and 5. The thermostat 50 can be a conventional, purchased unit that includes a bimetallic device which can be manually adjusted to a desired temperature setting by a control knob 52 mounted in a recessed portion of the top cap 30. (The showing of the thermostat in FIG. 1 is somewhat simplified. It preferably is of the type having an integrally combined tip-over switch that separates the thermostat contacts to deenergize the heater in the event the heater 10 is tipped over.)

With reference to FIG. 4 and 5, the temperature sensing portion 54 of the thermostat 50 is positioned between a pair of inwardly-directed baffles or deflectors 56 that are preferably integrally formed with the top cap 30. The deflectors 56 direct the air flowing upwardly through the air passage 28 onto the temperature sensing portion 54 of the thermostat 50. Since the air has been warmed during its upward flow, the temperature sensing portion 54 receives air which is an approximation of the ambient air temperature at a substantial distance above the floor. The preferred location of the thermostat 50 is on the underside of the top cap 30 because it provides satisfactory control of the heater circuit when so located and further because its control knob 52, which is preferably at a height of about two feet, is within easy reach of a standing person. This also simplifies the control of the thermostat 50 because it only needs a simple, short control shaft for connection to the knob 52.

The preferred heating element assembly 14 of this invention is located near the center rear of the heating chamber 17, at least about eight inches from the grill 22, and comprises a pair of side-by-side, vertically-oriented quartz heating elements 58 which are described in greater detail below. The two quartz heating elements 58 are confined to their vertical positions by a lower ceramic insulator or holder 60 and an upper ceramic insulator or holder 61. The holders 60 and 61 are received within elongate openings 62 and 64, respectively, in the reflective bottom wall 36 and the reflective top wall 38, respectively, of the reflector assembly 12.

With reference to FIGS. 9 through 12, each heating element 58 comprises an elongate, coiled resistance heater wire 100 located inside a hollow heat-radiating quartz tube 102 that is closed at its ends by the ceramic holders 60 and 61. Two cold wires or rods 104, one at each end of the resistance wire, and which are sufficiently stiff to have a self-supporting shape, are spot-welded to the resistance wire 100 in each radiating tube 102. (Here it may be noted that the diameters of the resistance wires 100 are shown somewhat oversized relative to the cold wires 104 in FIGS. 9 and 10. In actual practice, the resistance wires 100 are quite thin.) The ends of the cold wires 104 opposite the ends thereof welded to the resistance wires 100 are connected, as by crimped connectors 106, to flexible wires 108 that connect the resistance heater wires 100 into the heater control circuit, which will be described below.

The ceramic holders 60 and 61 are preferably of identical construction. The holder 60 will now be described but it will be understood that the holder 61 has the same construction. Holder 60 is provided with a pair of radiating tube-receiving sockets 110 that receive the lower ends of the quartz radiating tubes 102. The cold wires 104 are bent so that horizontally-extending sections 112 thereof lie in grooves 113 in the base surfaces, designated 114, of the sockets 110, and bent again to form vertically-extending legs 116 received in slots 118 that open to the side of the holder 60. During assembly of the heating elements 58, the cold wires 104 are again bent through 90 degrees to form horizontally-extending terminal portions 120 that project out of the body of the ceramic holder 60. Terminal portions 120 are partly confined in horizontal slots 122 which open in directions facing opposite to the directions faced by the sockets 110. The sides of the horizontal slots 122, prevent the terminal portions 120 from accidentally rotating about vertical axes. The horizontally-extending sections of the cold wires 104, because engaged with oppositely-facing surfaces of the holder 60, grip the holder 60 and thereby hold the entire heating assembly 14 together.

The cold wire 104 at the bottom of each heating element 58 extends horizontally outwardly in the space between the fan blade 48 and the lower ceramic holder 60 to a point sufficiently spaced in a horizontal direction from the center axis of the fan blade 48 that a flexible wire 108 can be safely connected thereto at that point so that it will not become entangled with the fan blade 48.

As previously mentioned, the annoying noise produced by a conventional quartz heater can be substantially reduced by applying a slight tension to the coiled resistance wires 100. This is readily accomplished in accordance with this invention because the resistance wires 100 are suspended by the upper cold wires 104 from the upper ceramic holder 61 and held from below by the engagement between the lower cold wires 104 and the lower ceramic holder 60. The vertical spacing between the base surfaces of the slots 122 is so selected that the resistance wire 100 is caused to be stretched in excess of its relaxed length by the desired length. The amount by which the coiled resistance wire is stretched and a possible theory as to why such stretch is useful for reducing noise are discussed above.

When the reflective walls 36 and 38 are assembled with the reflector 15, tabs 66 (FIG. 1) on the reflector panels 16, 18 and 20 extend through slots 68 in conventional fashion and are either bent over or crimped to make the walls 36 and 38 and panels 16, 18 and 20 into a unitary structure. With the ceramic holders 60 and 61 of the heating element assembly 14 being mounted in the bottom and top wall openings 62 and 64, respectively the heating element assembly 15 also becomes integral with the reflector assembly 12. The front grill 22 likewise becomes integral with the reflector assembly 12 by virtue of having several longer vertical wires 70 extending through holes 72 in the top reflector wall 38 and the bottom reflector wall 36. The longer vertical wires 70 also extend downwardly inside hollow, vertical support posts 73 forming part of the base plate assembly 24 and which assist in supporting the reflector assembly 15 above the base plate assembly 24. As is readily apparent, the entire heater 10 comprises a unitary assembly because the base plate assembly 24, the reflector assembly 15 and, accordingly, the parts integral with it, and the top cap 30 are all affixed by suitable fasteners to the outer wrapper 26.

Although it is preferred that the reflective side panels 16 and 18 are primarily located in planes that intersect at substantially 90 degrees, because this relationship is believed to be the most efficient in terms of uniform heating and minimum footprint, the side panels 16 and 20 could lie in planes that intersect at included angles between substantially 90 and less than 180 degrees. Concavely curved side panels, or side panels positioned at an included angle less than 90 degrees, would be inefficient and productive of hot spots since the heat energy would necessarily be focused to some extent. By placing the heating element assembly 14 in the position shown in FIG. 1, the reflective surfaces of the side panels 16 and 20 distribute radiated and reflected heat substantially uniformly across the grill 22. So too, the reflective bottom wall 36 and top wall 38, because horizontal, evenly disperse heat energy reflected therefrom across the grill 22 without focusing the heat energy in any direction. Any other orientation, or any curvature, of the bottom wall 36 and top wall 38 would be inefficient or cause a focusing of the heat energy.

An important advantage of the appliance design is to enable use of thermoplastic materials on many of the exterior parts. Such materials can often be molded into aesthetically pleasing shapes much more readily than metal parts. The top cap 30, the base plate 24, the front housing panel 46 and control knob 52 can all be made of ABS plastic. An example of the advantage of using molded plastic parts is that a finger-receiving handle, designated 78 in FIGS. 1 and 3, can be conveniently molded into the top cap 30.

Figure 13:
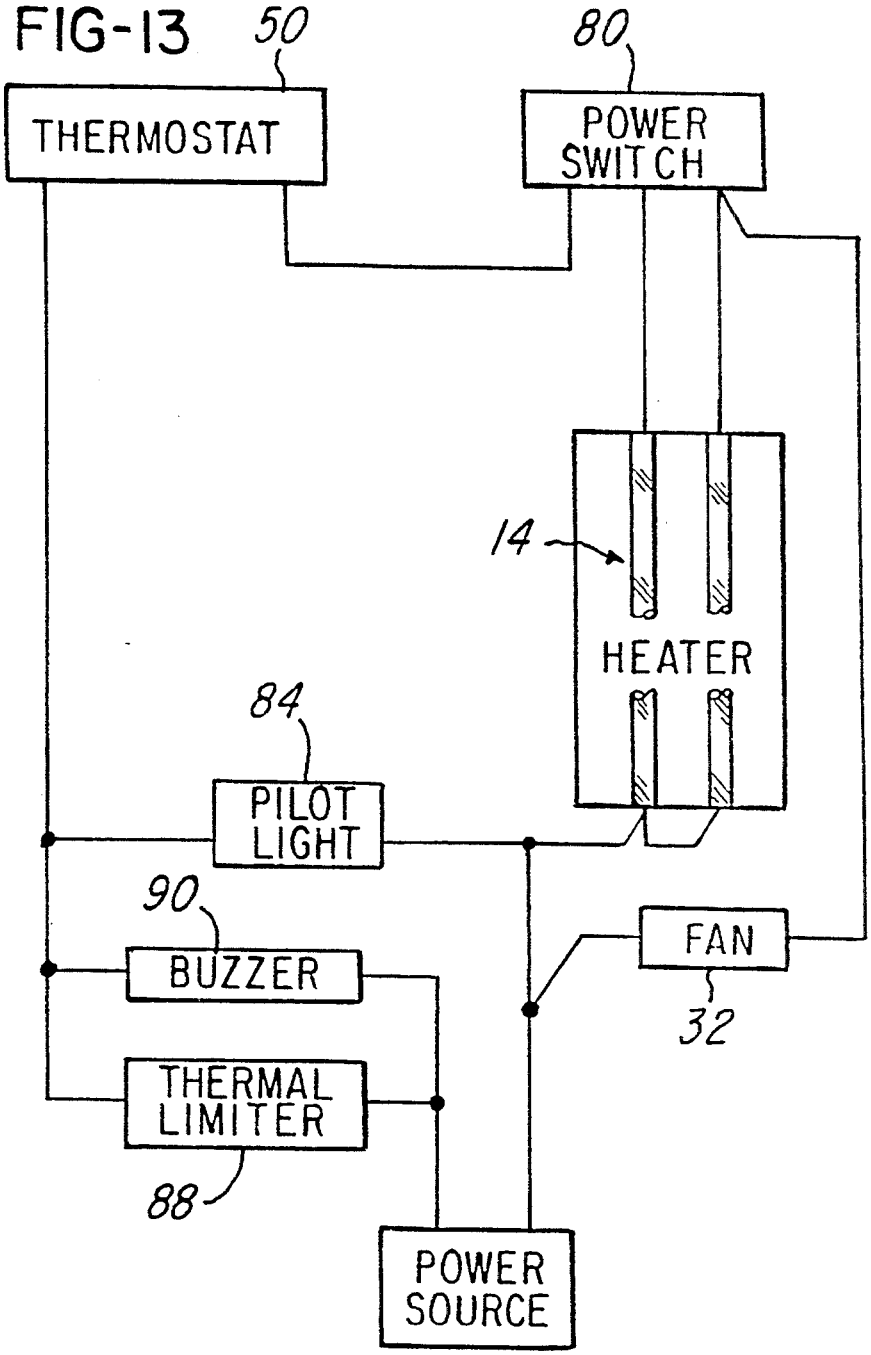
FIG. 13 is a schematic wiring diagram of the controls for the heater.

FIG. 13 illustrates a presently preferred control circuit for the heater 10. In addition to the thermostat 50, the heater 14 and the motor and fan assembly 32, the control circuit includes a three position power switch 80 for "off" and for energizing only one or else both of the heating elements 58. The power switch 80 is conveniently controlled by a knob 52 mounted on the top cap 30 adjacent the thermostat control knob 32 (FIGS. 1 and 2). A pilot light 84, which is shown only in FIG. 13, is energized only when the heater is energized. The pilot light 84 is preferably mounted to or plugged in the top cap 30 in alignment with a transparent lens 86 shown in FIGS. 1 and 2. To guard against abnormal conditions which could cause the reflector assembly 12 to become dangerously hot, a conventional thermal limiter 88 is mounted on the reflective bottom wall 36. The thermal limiter 88 creates on open circuit condition when overheated. It preferably is of the type which will automatically reset when cooled down but could be a manually resettable or else a one-shot device. A buzzer 90 is preferably provided to function as an alarm indicative of abnormal operation in the event that the thermal limiter 88 disables the heater circuit. Buzzer 90 is shown only in FIG. 13. It can conveniently be located in the fan chamber 34 and has such a high impedance that its presence in the circuit will not interfere with the operation of the thermal limiter.

Various other advantages of the structure described herein will become apparent from a review of this disclosure, and various changes may be made without departing from the spirit and scope of the claims.

Having described our invention, we claim:

1. An upright radiant electric heating appliance comprising:

a base plate;

a support mounted on said base plate;

a radiant heating assembly mounted on said support, said radiant heating assembly comprising:

a reflector assembly comprising a top wall having a front edge, a rear edge and opposed side edges angled outwardly from the rear edge toward the front edge at an angle substantially less than 180 degrees, and a bottom wall having a front edge, a rear edge and opposed side edges angled outwardly from the rear edge toward the front edge at an angle substantially less than 180 degrees;

a vertically-extending heating element assembly extending between said top wall and said bottom wall adjacent the rear edges of said top wall and said bottom wall and radiating energy throughout substantially 360 degrees;

said reflector assembly further comprising vertical panels extending between the side edges and the rear edges of both said top wall and said bottom wall, said panels having reflective front surfaces facing generally toward said heating element assembly, rear surfaces facing away from said heating element assembly and front vertical edges generally aligned with opposed ends of the front edges of said top wall and said bottom wall, said front surfaces of said panels being oriented to reflect radiant energy from said heating element assembly generally uniformly throughout substantially less than 180 degrees;

a rear housing panel mounted on said base plate and extending around said rear surfaces of said vertical panels between the front vertical edges of said reflector assembly, said rear housing panel being spaced horizontally from the rear surfaces of said vertical panels to form a vertically-extending air passage behind said panels;

said base plate and said bottom wall being mutually spaced to provide a fan chamber open to said air passage and to ambient air;

a fan mounted in said fan chamber, said fan forcing ambient air from the area surrounding the bottom of said heating appliance upwardly through said air passage;

a motor for driving said fan;

a top cap supported on the upper end of said rear housing panel and overlying said top wall of said radiant heating assembly, said top cap being spaced above said top wall and forming therewith a control chamber open to said vertically-extending air passage;

a heater control including a control knob and a temperature sensor mounted on said top cap, said temperature sensor being positioned in the path of air flow through said heater so as to be maintained at a temperature generally representative of ambient room air;

air outlet ducts extending through said top wall of said radiant heating assembly adjacent its front edge, through which ducts air driven by said fan is expelled from said radiant heater into a room; and a grill connected to the front edges of said top wall and said bottom wall of said reflector assembly, said grill being substantially open to permit radiant energy produced by said heating element assembly and reflected by said reflective surfaces to pass therethrough without substantial obstruction.

2. The appliance of claim 1 further comprising a lower front housing panel covering a portion of said fan chamber beneath said grill.

3. The appliance of claim 2 wherein both said rear housing panel and said lower front housing panel are apertured to admit ambient air into said fan chamber.

4. The appliance of claim 1 wherein said vertical panels comprise a pair of side panels that lie in respective vertical planes that intersect one another behind said heating element assembly at an included angle of between 90 degrees and 180 degrees and a rear panel spanning between said side panels behind said heating element assembly.

5. The appliance of claim 4 wherein said included angle is substantially 90 degrees.

6. The appliance of claim 4 wherein said side panels are formed with shallow, vertically-extending ribs to contribute rigidity thereto.

7. The appliance of claim 1 wherein said heating element assembly comprises a pair of hollow, vertical radiating tubes and resistance wires within both of said radiating tubes.

8. The appliance of claim 1 wherein said top cap is formed from a molded thermoplastic material which is maintained cool to the touch by air passing through said control chamber and said air outlet ducts.

9. The appliance of claim 8 wherein said top cap has an inverted finger-receiving handle portion molded integrally therewith, said handle being located at the rear of said top cap, remote from said grill.

10. The appliance of claim 1 wherein said top wall of said reflector assembly is horizontal and said top cap is so formed that the depth of said control chamber decreases from the rear toward the front so that air flowing therethrough is accelerated as it approaches said ducts in order to enhance the cooling effect on said top cap and the upper end of said grill as air flows through said ducts.

11. The appliance of claim 1 wherein said fan has an upwardly-facing blade spaced closely to the underside of said bottom wall, and wherein the outer periphery of said fan blade is closely adjacent the rear panel so as to have an effective area of the fan blade in vertical alignment with said air passage to cause vertical air flow from said effective area of said fan blade upwardly through said air passage.

12. The appliance of claim 11 wherein said heating element assembly is vertically above said fan blade, said heating element assembly including at least one quartz heating element comprising a vertically-oriented hollow quartz radiating tube, an upper insulating holder that holds said radiating tube in fixed relation to said top wall, a lower insulating holder that holds said radiating tube in fixed relation to said bottom wall, a coiled resistance heater wire within said radiating tube, an upper cold wire connected to the top of said heater wire and extending through said upper insulating holder, a lower cold wire connected to the bottom of said resistance wire, said lower cold wire having a horizontally-extending lower portion projecting out of said lower insulating holder and located in the space between said fan blade and the underside of said bottom wall, and a flexible electric wire connected to said lower cold wire at a point spaced horizontally from said lower holder by a distance sufficiently far from said lower holder that a flexible wire used to connect the heating element into the heater control circuit can be connected thereto at a point at which the flexible wire will not fall into the path of the fan blades, and means for connecting a flexible electrical wire to said lower cold wire at said point.

13. The appliance of claim 1 wherein said air outlet ducts direct air downwardly and outwardly at an angle with respect to said top wall so as to evacuate rising heated air away from the top of said reflector assembly and expel it into the ambient air.

14. The appliance of claim 13 wherein said ducts are formed by stamping in said top wall a plurality of upwardly and rearwardly-facing air deflectors.

15. The appliance of claim 1 further comprising air-directing baffles in said control chamber adjacent the rear edge of said top wall for directing air to flow-across said temperature sensor.

16. The appliance of claim 15 wherein said heater control includes a temperature sensing and controlling thermostat, and wherein said baffles comprise a pair of opposed baffles directed inwardly from opposite side edges of said top cap having mutually spaced inner edges, and wherein said thermostat is located essentially in the space between said inner edges of said pair of baffles.

17. The appliance of claim 1 wherein the outer edges of said top wall, said bottom wall and said grill are outwardly convex whereby radiant energy from said heating element assembly and reflected heat from said reflector assembly are distributed essentially uniformly at said grill.

18. The appliance of claim 7 wherein each of said radiating tubes has upper and lower ends and the resistance wire contained within each tube is stretched between the upper and lower ends of the tube in which it is contained.

19. The appliance of claim 12 wherein said resistance wire is slightly stretched between said holders.

20. An upright radiant electric heating appliance comprising:

a reflector assembly having a horizontal, reflective top wall having a front edge, a rear edge and opposed side edges angled outwardly at an angle substantially less than 180 degrees but not less than 90 degrees, a horizontal, reflective bottom wall having a front edge, a rear edge and opposed side edges angled outwardly at an angle substantially less than 180 degrees but not less than 90 degrees, and three vertical panels extending between the side edges and rear edges of both said top wall and said bottom wall; and a heating element assembly extending vertically between said top wall and said bottom wall, said heating element assembly radiating energy throughout substantially 360 degrees; and said panels having reflective surfaces facing toward said heating element assembly and said surfaces being oriented to reflect radiant energy from said heating element assembly throughout an angle of substantially less than 180 degrees but not less than 90 degrees.

21. The heating appliance of claim 20 wherein said panels comprise a pair of side panels that lie in respective vertical planes that intersect one another behind said heating element assembly at an included angle of less than 180 degrees but not less than 90 degrees and a rear panel between said side panels and behind said heating element assembly.

22. The heating appliance of claim 20 wherein the front edges of both said top wall and said bottom wall are outwardly convex, and wherein an outwardly convex grill is connected between said top wall and said bottom wall at their respective said front edges, said grill being substantially open to permit radiant energy produced by said heating element assembly and reflected by said reflective surfaces to pass therethrough without substantial obstruction.

23. The heating appliance of claim 20 wherein said heating element assembly comprises a pair of closely-spaced parallel resistance wires each of which is encased in a hollow heat-transmitting glass radiating tube.

24. The combination of claim 23 wherein each of said radiating tubes has upper and lower ends and the resistance wire contained within each tube is stretched between the upper and lower ends of the tube in which it is contained.

25. An upright radiant electric heating appliance comprising:

a reflector assembly;

a vertically-extending heating element assembly supported in said reflector assembly;

a rotatable fan spaced below a lower end of said heating element assembly, said fan having a blade assembly with a center axis, part of said blade assembly being vertically aligned with said heating element assembly;

a stiff cold wire having a self-supporting shape extending horizontally outward from said heating element assembly in the space between said fan blade and the lower end of said heating element assembly; and a flexible wire for carrying electric current attached to said cold wire at a point sufficiently spaced from the center axis of said fan blade that said flexible wire will not become entangled with said fan blade assembly.

26. The appliance of claim 25 wherein said heating element assembly comprises a vertical heat-radiating tube and a vertical coiled resistance wire in said radiating tube, and wherein said cold wire is connected to the lower end of said coiled resistance wire.

27. The appliance of claim 26 wherein a second, upper cold wire is connected to the upper end of said resistance wire, wherein said heating element assembly further comprises an upper holder and a lower holder, said upper cold wire is suspended from said upper holder and said lower cold wire is connected to said lower cold wire, and said resistance wire is slightly stretched between said holders.

28. An upright radiant electric heating appliance comprising:

a reflector assembly having vertically-extending reflective panels bounding a heating chamber having an open front, said panels including reflective side panels angled outwardly from the rear to the front of said heating chamber at a mutually included angle of substantially less than 180 degrees but not less than 90 degrees; and a heating element assembly extending vertically through said heating chamber, said heating element assembly radiating energy throughout substantially 360 degrees;

whereupon radiant energy from said heating element is reflected by said side panels through an angle of substantially less than 180 degrees but not less than 90 degrees.

29. The heating appliance of claim 28 wherein said reflector assembly further comprises:

a horizontal top wall bounding said heating chamber, said top wall having a front edge, a rear edge and opposed side edges, and a horizontal bottom wall bounding said heating chamber, said bottom wall having a front edge, a rear edge and opposed side edges, said front edge of said bottom wall having the same shape as the front edge of said top wall and vertically aligned therewith; and wherein said panels extend vertically between said top wall and said bottom wall.

30. The heating appliance of claim 29 wherein the front edges of both said top wall and said bottom wall are outwardly convex, and wherein an outwardly convex grill is connected between said top wall and said bottom wall at their respective said front edges, said grill being substantially open to permit radiant energy produced by said heating element assembly and reflected by said reflective surfaces to pass therethrough without substantial obstruction.

31. The heating appliance of claim 29 wherein said panels further comprise a rear panel between said side panels and behind said heating element assembly.

32. The combination of claim 31 wherein said heating element assembly comprises a pair of closely-spaced parallel resistance wires each of which is encased in a hollow heat-transmitting glass radiating tube.

33. The combination of claim 32 wherein each of said radiating tubes has upper and lower ends and the resistance wire contained within each tube is stretched between the upper and lower ends of the tube in which it is contained.

* * * * *